US006408986B1

(12) United States Patent
Ayano et al.

(10) Patent No.: US 6,408,986 B1
(45) Date of Patent: Jun. 25, 2002

(54) CHARGER FOR ELEVATOR CALL DEVICES

(75) Inventors: Hideki Ayano, Hitachi; Hiromi Inaba, Hitachinaka; Sadao Hokari, Hitachinaka; Atsuya Fujino, Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/791,714

(22) Filed: Feb. 26, 2001

(30) Foreign Application Priority Data

Aug. 29, 2000 (JP) ..... 2000-259644

(51) Int. Cl.[7] ..... B66B 1/06
(52) U.S. Cl. ..... 187/290; 187/413; 187/380
(58) Field of Search ..... 187/290, 380, 187/391, 393, 394, 413, 414; 320/2, 12, 21

(56) References Cited

U.S. PATENT DOCUMENTS 4,011,928 A * 3/1977 Spear et al. ..... 187/29 R
4,346,789 A * 8/1982 Ekholm ..... 187/29 R
4,402,386 A * 9/1983 Ficheux et al. ..... 187/29 R
5,157,319 A * 10/1992 Klontz ..... 320/2
5,412,542 A * 5/1995 Mandy ..... 187/390
5,568,036 A * 10/1996 Hulsey et al. ..... 320/2
5,732,795 A * 3/1998 McCarthy et al. ..... 187/250
6,116,281 A * 9/2000 Jalbert ..... 187/395
6,117,790 A1 * 1/2001 Emberty et al. ..... 323/347
6,333,865 B1 * 12/2001 Yumura ..... 187/295

FOREIGN PATENT DOCUMENTS

JP 49-42036 * 9/1974
JP 57-112275 * 7/1982
JP 57-121586 * 7/1982
JP 1-209287 * 1/1989
JP 5-294568 * 5/1993
JP 5-294568 * 11/1993

* cited by examiner

*Primary Examiner*—Jonathan Salata
(74) *Attorney, Agent, or Firm*—Antonelli, Terry, Stout & Kraus, LLP

(57) ABSTRACT

An elevator capable of supplying electric power to accessory hall devices such as up/down elevator buttons and position indicators without requiring power supply lines between the cage and each hall. A drive battery which supplies electric power to hall devices provided in each hall and a receptor connected to the battery are provided on the hall. A feeder contactable with the respective receptors, a charging device that charges the battery via the feeder and receptor are provided on the top of the cage. When the charging voltage, for example, used in a hall of the floor drops below a predetermined voltage value, the cage stops automatically at the floor and the charger charges the drive battery in the hall of the floor via the receptors and feeder.

17 Claims, 3 Drawing Sheets

1 : DRIVE BATTERY
2 : ACCESSORY HALL DEVICES
5 : CHARGER

1 : DRIVE BATTERY
2 : ACCESSORY HALL DEVICES
5 : CHARGER

1 : DRIVE BATTERY
2 : ACCESSORY HALL DEVICES
5 : CHARGER

CHARGER FOR ELEVATOR CALL DEVICES

BACKGROUND OF THE INVENTION

The present invention relates to an elevator with accessory hall devices that include up/down elevator buttons and a position indicator provided in an elevator hall of each of building floors.

In an conventional elevator, up/down buttons and a position indicator, attached in each of the elevator halls and indicative of the position and moving direction of the cage, receive electric power from an elevator machine room directly via power feeding lines. A method of feeding electric power from each floor to the cage was proposed as a contact type power feeding method disclosed in JP-A-49-42036. A non-contact type power feeding method is proposed, for example, in JP-A-5-294568 and 57-121568.

SUMMARY OF THE INVENTION

With the above mentioned conventional techniques, electric power is supplied directly via the feeding lines to the up/down buttons and the position indicator installed in each elevator hall from the elevator machine chamber. Thus, a voltage drop across the feeding lines increases as the building in which the elevator is installed becomes higher. Thus, as the length of feeding lines increases, its diameter must be increased, which would lead to an increase in costs.

When connections are made from the feeding lines to the respective up/down elevator buttons and indicators, the number of contacts concerned increases as the building where the elevator is installed becomes higher. Thus, wrong connections are liable to occur and maintenance/management is very difficult. Of course, there is a problem concerning a rather limited construction term for wiring work to be done at the site.

The present invention is made in view of those problems in the prior art. It is an object of the present invention to provide an elevator capable of supplying electric power to accessory hall devices provided in a hall of each of the floors for the elevator without the necessity for providing feeding lines between the cage and the hall.

In order to achieve the above object, according to the present invention, there is provided an elevator comprising: a cage for moving up and down though a shaft; a plurality of groups of accessory hall devices each group provided near the elevator in an elevator hall formed on a respective one of floors of a building; a plurality of drive batteries each provided in a respective one of the halls for providing electric power to the plurality of groups of accessory hall devices provided in the hall; a charging device provided on the cage for charging each of the plurality of drive batteries.

In such arrangement of the present invention, electric power is supplied in a contact or non-contact manner from the charging device mounted on the cage to the drive battery provided in the respective hall. The battery supplies power to the hall devices that include the up/down elevator buttons and indicator. Thus, electric power is supplied to the hall devices without the necessity for providing feeding lines especially between the cage and each hall. The electric power supplied by the charging device is a part of power supplied from the tail cord for cage illumination and door motor driving. Electric power consumed by the hall devices that include the up/down elevator buttons and indicators is very small compared to the power consumed for the cage illumination and door motor driving. Thus, the diameter of the tail cord does not increase greatly.

BRIEF DESCRIPTION OF THE DRAWINGS

The forgoing and other objects, features and advantages of the invention will be account from the following more particular description of the embodiments of the invention as illustrated in the accompanying drawings wherein.

DESCRIPTION OF THE EMBODIMENTS

Embodiments of the inventive elevator will be described next with reference to the accompanying drawings.

Figure 1:
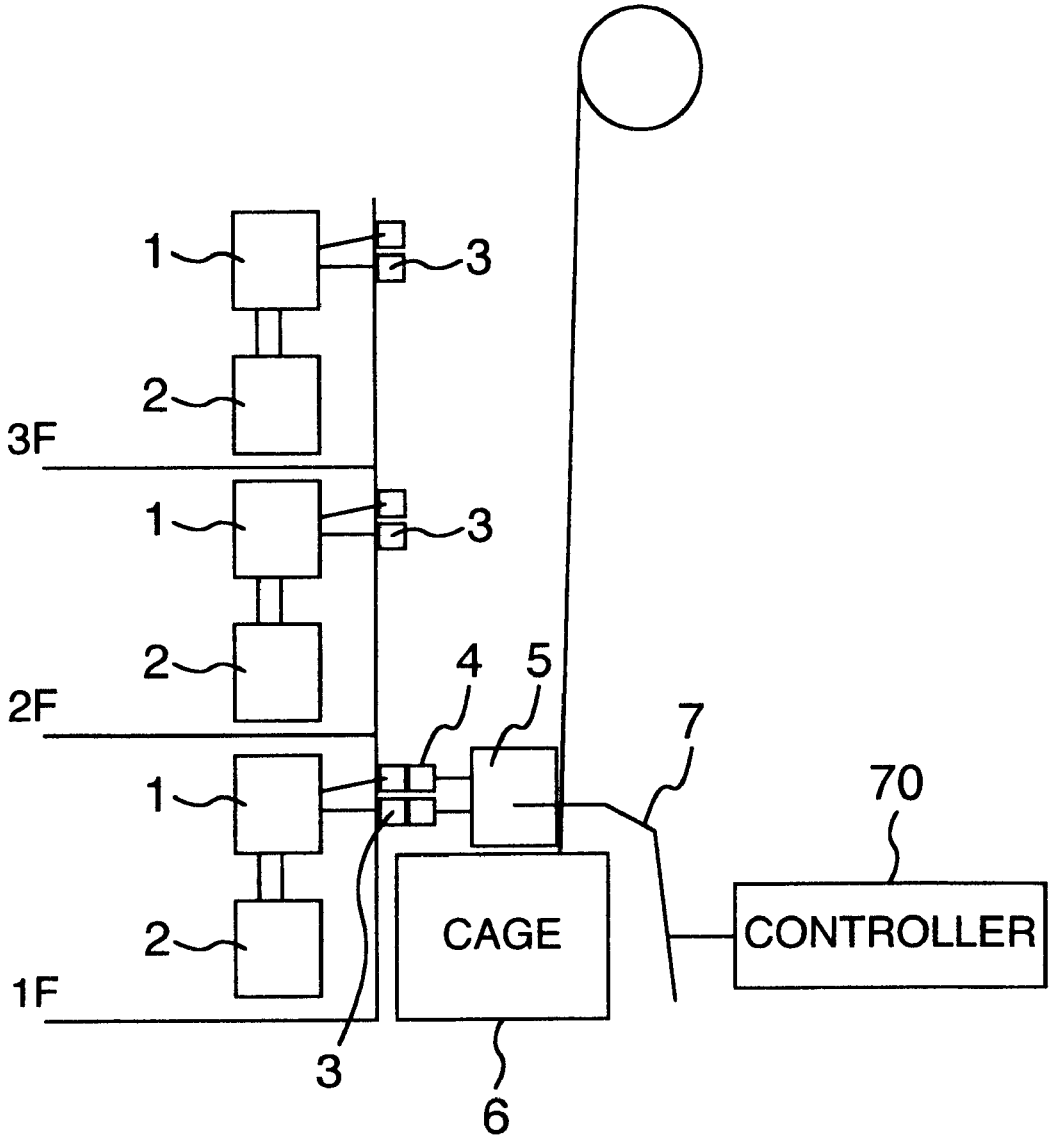
FIG. 1 is a block diagram of an elevator according to a first embodiment of the present invention.

FIG. 1 is a block diagram of the elevator according to a first embodiment of the present invention. In the elevator of FIG. 1, a drive battery 1 that supplies electric power to accessory hall devices 2 that include up/down elevator buttons and a position indicator, and a pair of receptors 3 of a high conductivity metal connected to the battery 1 are provided in a hall of each of floors 1F, 2F and 3F. Provided on top of the cage 6 are a pair of feeders 4 of a high conductivity metal capable of contacting with the corresponding receptors 3 and a charging device or charger 5 that is capable of charging the battery 1 via the pair of feeders 4 and the pair of receptors 3 concerned. The charger 5 receives power via a tail cord 7.

In the elevator of the first embodiment, a battery voltage detector (not shown) attached to the drive battery 1 in the hall of each of the floors 1F–3F detects a charging voltage. A reference charging voltage value for the charging voltage is set so as to be higher than a voltage at which the hall devices 2 can continue to operate until the cage 6 arrives at a floor where a call for the cage 6 has originated. Thus, there occurs no trouble in proper operation of the cage 6 during travel on the way to the calling hall for charging purposes.

For example, when the charging voltage used in the elevator hall of the floor 3F falls below the reference voltage value, the cage 6 is moved automatically by communication means such as wireless ones toward that floor 3F and then stops there. At this time, a charge start command value is produced based on sensed values of position sensors such as position detectors (not shown) placed on the respective floors, and an encoder and a position detector connected to the motor to thereby control the stop position of the cage 6 accurately. Then, the receptors 3 are connected with the corresponding feeders 4 when the cage 6 is at a stop. Thus, electric power is charged from the charger 5 to the drive battery 1 provided in the hall of the floor 3F via the receptors 3 and the corresponding feeders 4.

In the arrangement of the first embodiment, the drive batteries 1 installed in the respective halls of the floors 1F–3F are charged from the charger 5 when the cage 6 is at a stop at the respective halls. Thus, power is supplied to the accessory hall devices 2 provided on each hall without the necessity for providing supply lines especially between the cage 6 and the respective halls.

The first embodiment illustrates that the receptors 3 at the floor where the cage is at a stop are brought into direct contact with the corresponding feeders 4 for power supply. These receptors 3 and feeders 4 are made of a high conductivity metal via which the accessory devices 2 receive energy from a control panel (not shown) also via the tail cord 7 from the charger 5 with high efficiency. The power supplied by the charger 5 is a part of the power supplied via the tail cord 7 for illuminating the cage 6 and driving the door motor. The power consumed by the hall devices 2 which include the up/down elevator buttons and the indicators is extremely small compared to that consumed by the cage illumination and door motor driving. Thus, there is no problem that the diameter of the tail cord 7 must undesirably increase very greatly.

When in the first embodiment the charging voltage used in the hall of each of the floors 1F–3F drops below the reference voltage value to operate the cage 6 automatically, the cage 6 is started up remotely by communication means such as the wireless one. Thus, there is no necessity for special communication lines to be provided.

In the first embodiment the cage 6 is illustrated as being automatically operated when the charging voltage used in the hall of each of the floors 1F–3F drops below the reference voltage value. Arrangement may be such that when a predetermined time is reached, a controller 70 gives an operational command to the cage 6 to operate and stop the cage 1 automatically at the respective halls of the floors 1F–3F to thereby charge the respective drive batteries 1 provided on the corresponding halls. In this case, only an inexpensive built-in timepiece is required to be provided and no special communication means is required to be provided.

Figure 2:
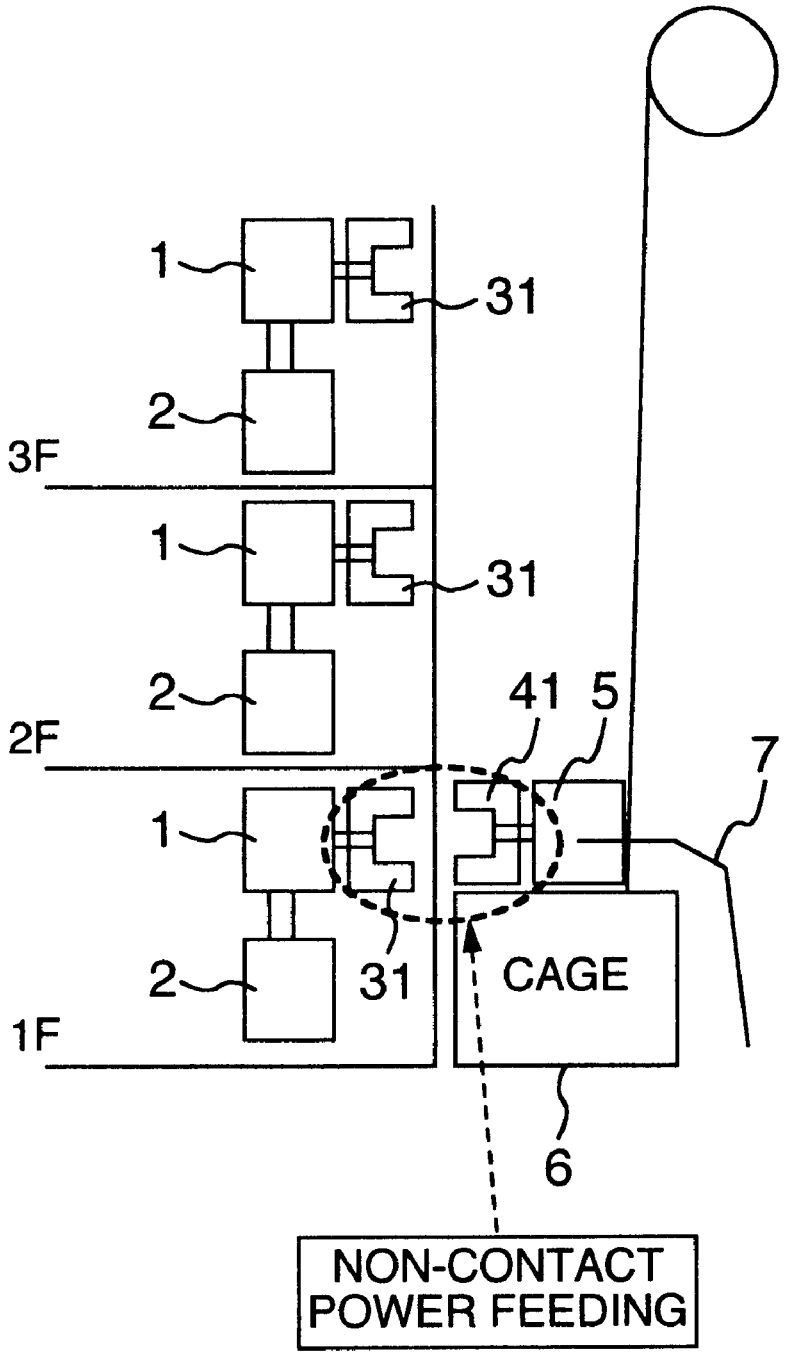
FIG. 2 is a block diagram of an elevator according to a second embodiment.

FIG. 2 is a block diagram of an elevator according to a second embodiment of the present invention. In FIG. 2, an element equivalent to that of FIG. 1 is designated by the same reference numeral as used for designating the element of FIG. 1.

The elevator of FIG. 2 is different from the embodiment of FIG. 1 in that the former employs a non-contact power supply system. More particularly, it includes a plurality of non-contact receptors 31 each to be connected to a respective one of the drive batteries 1 provided in the corresponding halls of the floors 1F–3F, and a non-contact power feeder 41 connected to the charger 5 provided on top of the cage 6. The receptors 31 and the feeder 41 are each made of a magnetic material such as ferrite. The remaining composition of the elevator is basically the same as the corresponding composition of the first embodiment of FIG. 1.

With the elevator of the second embodiment, when the cage 1 stops at the hall of each of the floors 1F–3F and the receptor 31 in the hall faces the feeder 41, the drive battery 1 receives power from the charger 5 from the charger 5 via the receptor 31 and the feeder 41, using an electromagnetic induction.

Even with this elevator, the charger 5 can charge the drive battery 1 provided in the hall of each of the floors 1F–3F when the cage 6 is at a stop at the hall. Thus, power can be supplied to the corresponding hall devices 2 without necessitating special feeder lines between the cage 6 and that hall. Furthermore, by employing the non-contact power feeding system, the receptors 31 and the feeder 41 are prevented from corroding due to rust or deteriorating due to friction. Also, no noise is produced which would otherwise be produced due to contact of the feeder 41 with the respective receptors 31.

While in the second embodiment the non-contact receptors 31 are illustrated as being connected to the respective drive batteries 1 provided in the halls of the floors 1F–3F, converters (not shown) may be connected between the respective drive batteries 1 and the corresponding non-contact power receptors 31.

Figure 3:
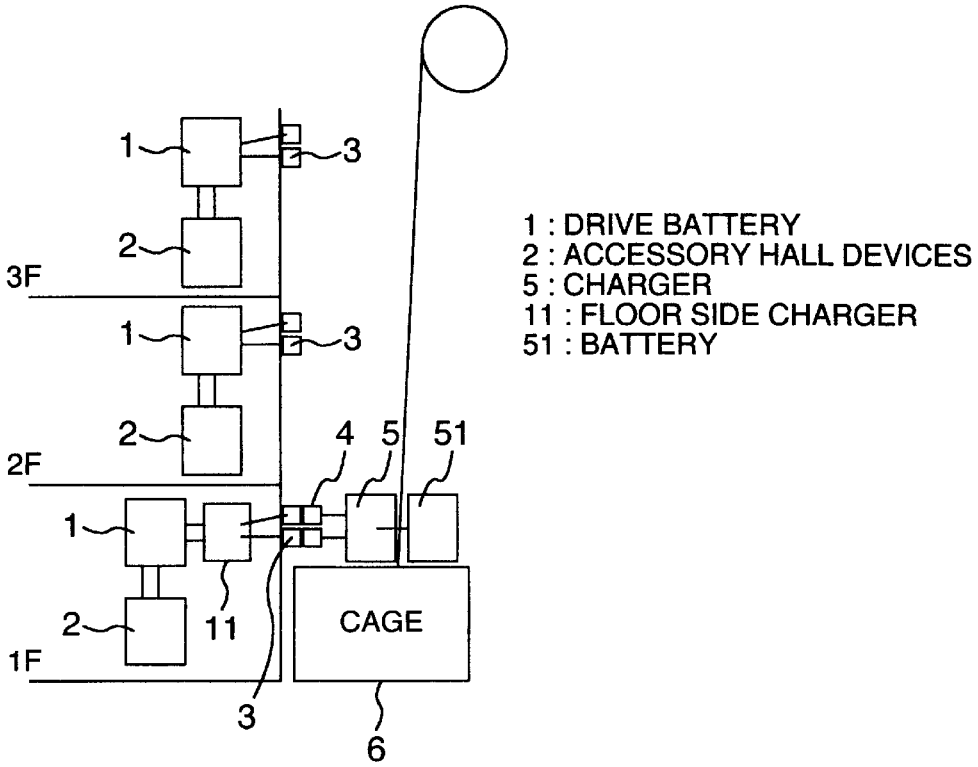
FIG. 3 is a block diagram of an elevator according to a third embodiment.

FIG. 3 is a block diagram of an elevator according to a third embodiment of the present invention. An element of the third embodiment equivalent to a corresponding one of each of the embodiments of FIGS. 1 and 2 is designated by the same reference numeral as used for designating the corresponding one in FIGS. 1 and 2.

The elevator of FIG. 3 is different from that of FIG. 1 in that in the former a floor side charger 11 is provided in a predetermined one of the halls of the floors, for example, in the hall of the first floor 1F and that a battery 51 connected to the charger 5 is provided on top of the cage 6. The remaining composition of the third embodiment is basically the same as that of the embodiment of FIG. 1. The elevator. of FIG. 3 is the same as that of FIG. 1 in that the cage 6 supplies power to the respective drive batteries 1 provided in the halls of the floors 2F and 3F.

With the elevator of the third embodiment, a power supply (not shown) installed on the hall of the floor 1F supplies power to the charger 11 of the hall of the floor 1F and as shown in FIG. 3, the receptors 3 are connected to the corresponding feeders 4 when the cages at a stop. Thus, the charger 11 in the hall of the floor 1F supplies power to the battery 51 on the cage 6 via the receptors 3 and the corresponding feeders 4. Then, when the cage 6 rises and stops at the hall of the floor 2F, the receptors 3 of the hall comes into contact with the corresponding feeders 4 of the cage 6. Thus, the battery 51 on the cage 6 charges the drive battery 1 in the hall of the second floor 2F via the receptors 3 and the corresponding feeders 4. Similarly, when the cage 6 stops at the hall of the floor 3F, the battery 51 charges the drive battery 1 in the hall.

Even with the elevator of the third embodiment, power can be supplied to the hall devices 2 without providing feeder lines especially between the cage 6 and the respective halls of the floors 1F–3F.

Since in the third embodiment the battery 51 is provided on top of the cage 6, the battery 51 can easily be exchanged with another through a manhole (not shown) provided in the top of the cage 6 to thereby improve the maintenance. Further, if the battery 51 is installed in the control panel (not shown) within the cage 6, associated wiring is required, but maintenance is further improved.

The third embodiment is very effective for the system in which power is supplied from the floor side to the cage 6 side in the contact or non-contact manner for the cage illumination and door motor driving to thereby eliminate the necessity for the tail cord that connects the control panel and the cage 6. In addition, by sending/receiving signals such as input/output information via a wireless device to/from the hall devices 2 that include the up/down elevator buttons and the position indicators, a so-called completely non-wired elevator is provided.

It is a matter of course that the third embodiment may be applied with the second embodiment of FIG. 2 in which the drive battery 1 is charged in the non-contact power supply system, to thereby produce advantageous effects similar to those produced by the third embodiment.

In the third embodiment the predetermined hall where the floor side charger 11 is provided is illustrated as the hall of the first floor 1F. It is desirable to cause the charger 11 to charge the drive battery at the so-called "reference" floors where many persons or articles move into/out of the cage most frequently. This is because power of the drive battery 1 consumed by the up/down buttons and position indicators provided on the reference floor is higher than the respective power consumptions of the batteries provided in the halls of other floors, so that the battery on the reference floor is charged more efficiently from the power supply. Since the time period when the cage 6 is at a stop at the reference floor is long, the battery 51 of the cage 5 can be without haste charged with a small current on the reference floor to thereby contribute to extension of the life time of the battery 51. Note that the power supply may be used directly without using the drive battery 1 at the reference floor.

Figure 4A:
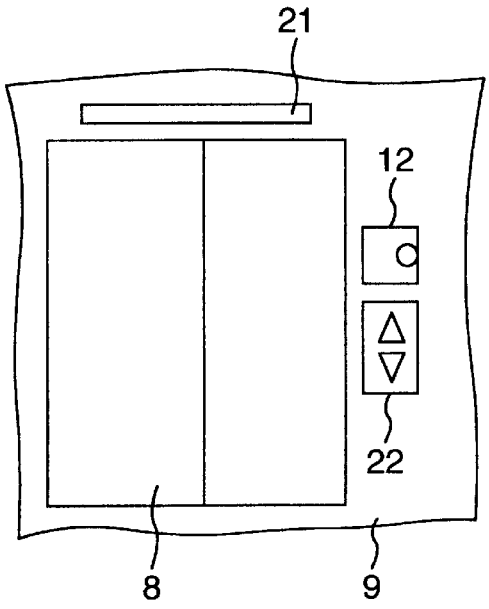
FIG. 4A is a front view of a hall door for an elevator as its essential portion of a fourth embodiment.

FIGS. 4A and B show essential portions of an elevator of the fourth embodiment. FIGS. 4A and B are a front view of an elevator door and a cross-sectional view of the elevator portion near the door, respectively. An element of the fourth embodiment of FIGS. 4A and B that is identical to that of each of the embodiments of FIGS. 1–3 is designated by the same 10 reference numeral as used to designate that element of each of those embodiments.

Figure 4B:
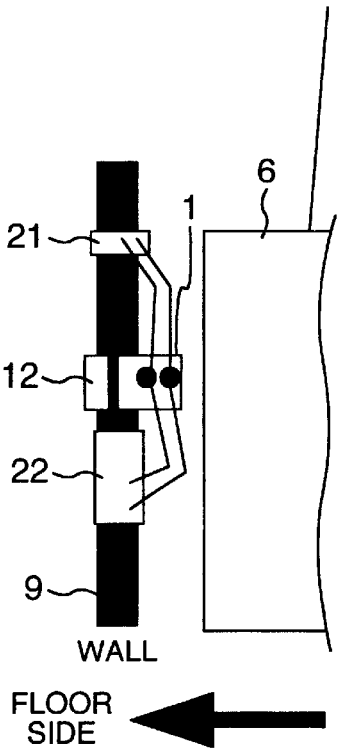
FIG. 4B is a cross-sectional view of a hall door for the elevator of FIG. 4A.

In the elevator of the FIG. 4 embodiment, drive battery 1 is installed on the back of the wall 9, which faces the cage 6, adjacent to a hall door 8. A door 12 for the drive battery 1 is provided on the side of the front of the wall 9. A position indicator 21 is provided above the elevator door 8 with up/down elevator buttons 22 being provided directly below the battery door 12.

In the elevator of this embodiment, the drive battery 1 is provided between the floor side surface of the wall 9 adjacent to the door 8 and the floor side surface of the cage 6. By opening the battery cover 12 provided at the wall 9, the drive battery 1 is exposed and can be replaced from the hall side.

In the arrangement of the elevator of the fourth embodiment, installation and maintenance of the drive battery 1 is very easy. In addition, if the up/down elevator buttons 22 are caused to indicate the remaining voltage value of the battery 1/information on whether the battery should be exchanged, inspection for replacement of the battery 1 on each floor is facilitated.

While the respective embodiments of the present invention have been described in the above, the present invention is not limited to those embodiments and many changes and modifications are possible within the scope of the claims attached hereto without departing from its spirit.

As described above, according to the respective elevators of the embodiments, power can be supplied to the accessory hall devices which include the up/down elevator buttons/indicators without providing special power supply lines between the cage and the respective halls. Thus, the prior art power supply lines through which power is supplied to the hall devices installed on the respective floors are eliminated. Thus, the complicated wiring work that is required in the prior art for power supply in the elevator which is installed especially in a high building is simplified to thereby greatly reduce a quantity of labor required for cable extension/maintenance. An energy loss that has been produced in the conventional power supply lines is eliminated to thereby reduce the voltage drop concerned.

What is claimed is:

1. An elevator comprising:

a cage for moving up and down through a shaft;

a plurality of groups of accessory hall devices each group provided near the elevator in an elevator hall formed on a respective one of floors of a building;

a plurality of drive batteries each provided in a respective one of the halls for providing electric power to the plurality of groups of accessory hall devices provided in the hall;

a charging device provided on said cage for charging each of said plurality of drive batteries.

2. The elevator according to claim 1, wherein each said group of accessory hall device provided in the hall concerned comprise at least one of a up/down elevator button for outputting a call command to said cage and a position indicator for indicating a position and a moving direction of said cage.

3. The elevator according to claim 1, wherein when said cage is at a stop at one of the halls, the drive battery in the hall is charged.

4. The elevator according to claim 3, wherein a charge command is outputted to said charging device based on a sensed value outputted from a position sensor used for control of the position of said cage.

5. The elevator according to claim 1, comprising a controller for outputting an operation command for said cage when a predetermined time is reached, for moving said cage to a predetermined position in accordance with the operation command, and for charging the drive battery at the predetermined position.

6. The elevator according to claim 1, wherein in response to the charging voltage of the drive battery dropping below a predetermined reference voltage value, said cage is automatically operated to thereby charge said drive battery.

7. The elevator according to claim 6, wherein said cage is started up in accordance with wireless communication performed within said accessory hall devices on the floor concerned.

8. The elevator according to claim 6, wherein the reference voltage value is high enough to continue to operate until said cage reaches a hall of a floor where a call for said cage has originated.

9. The elevator according to claim 1, wherein each said group of hall devices provided in the hall comprises a wireless device for sending/receiving input/output information.

10. The elevator according to claim 1, wherein electric power is supplied to said charging device in a hall of a predetermined floor.

11. The elevator according to claim 10, wherein the hall of the predetermined floor comprises a predetermined reference floor.

12. The elevator according to claim 1, wherein said drive battery is charged in a non-contact manner.

13. The elevator according to claim 1, wherein the drive battery is set between a floor side surface of said cage and a floor side surface of a an outer elevator wall adjacent to a door for a hall of each floor.

14. The elevator according to claim 13, comprising a door for the drive battery provided on the floor side of the wall so that when the door is opened the drive battery can be replaced with another.

15. The elevator according to claim 1, wherein a voltage of the drive battery or information on whether the battery should be replaced with another is indicated.

16. The elevator according to claim 10, wherein said charging device provided on said cage includes a battery.

17. The elevator according to claim 16, wherein said battery which said charging device includes is installed at a position where the battery can be replaced with another from the inside of said cage.

* * * * *

UNITED STATES PATENT AND TRADEMARK OFFICE

CERTIFICATE OF CORRECTION

PATENT NO. : 6,408,986 B1 
DATED : June 25, 2002
INVENTOR(S) : Ayano et al.

It is certified that error appears in the above-identified patent and that said Letters Patent is hereby corrected as shown below:

Column 1,
Line 45, delete “though” and insert -- through --

Signed and Sealed this

First Day of July, 2003

JAMES E. ROGAN
*Director of the United States Patent and Trademark Office*